United States Patent [19]

Calhoon

[11] Patent Number: 4,890,835

[45] Date of Patent: Jan. 2, 1990

[54] BOWLING BALL

[76] Inventor: William R. Calhoon, 219 Sandy Cir., South Daytona, Fla. 32019

[21] Appl. No.: 237,882

[22] Filed: Aug. 29, 1988

[51] Int. Cl.[4] ..... A63B 37/10

[52] U.S. Cl. ..... 273/63 E; 273/63 G

[58] Field of Search ..... 273/63 E, 63 R, 63 C, 273/63 G

[56] References Cited

U.S. PATENT DOCUMENTS

| | | | |
|---|---|---|---|
| 531,103 | 12/1894 | Dokkenwadel | 273/63 R |
| 3,441,274 | 4/1969 | Collins | 273/63 E |
| 4,121,828 | 10/1978 | Amburgey | 273/63 E |
| 4,320,899 | 3/1982 | Salvino | 273/63 E |
| 4,523,757 | 6/1985 | Swett et al. | 273/63 E |
| 4,592,551 | 6/1986 | Lee | 273/63 E |
| 4,655,454 | 4/1987 | Amburgey | 273/63 E |

*Primary Examiner*—George J. Marlo

*Attorney, Agent, or Firm*—Edward M. Livingston

[57] ABSTRACT

A new bowling ball with specially located weight implants to compensate for weight loss and correct imbalances caused by removing material when drilling finger holes, as well as to yield improved hooking control. This improved bowling ball has three weights or implants inserted in the core of the ball, one conical-shaped implant positioned in the core halfway between the thumb hole and finger hole, and the other two weight implants positioned equi-distant from the first weight implant at the 3 and 9 o'clock positions relative to the first weight implant. After the weight implants are inserted in the core, a covering is placed around the core, and then the thumb and finger holes are drilled in the proper positions. This new bowling ball provides significantly improved handling characteristics and enables the user to curve or hook the ball more easily to obtain higher scores.

5 Claims, 1 Drawing Sheet

BOWLING BALL

BACKGROUND OF THE INVENTION

This invention relates to bowling balls, and more particularly to bowling balls with weights implanted to compensate for weight loss caused by drilling finger holes in the balls and to improve performance characteristics of the bowling ball.

Normally in the sport of ten-pin bowling, a large ball is used, ranging in weight from 8 to 16 pounds, to knock down ten large pins. These bowling balls are drilled with three holes, one for the thumb and two for the middle and ring fingers, to provide the bowler with a hand-grip on the ball. Since drilling these holes in the bowling ball removes material from the balls, the ball becomes unbalanced unless weight is added to the ball to compensate for same.

Many methods have been proposed to compensate for weight loss and imbalance due to the drilling of thumb and finger holes. The most common method is to insert weighted blocks, caps or pegs into the ball at various locations in the ball. For instance, U.S. Pat. No. 3,441,274 by Collins shows a bowling ball with screw-in plugs, two on opposite sides of the ball and one between the thumb and finger holes. U.S. Pat. No. 2,414,672 by Sauer shows a bowling ball having finger tips with weighted caps to off-set weight removed by drilling other holes. U.S. Pat. No. 531,103 by Dokkenwadel shows the insertion of a weight in the center of the ball to add weight and to balance the ball. U.S. Pat. No. 3,810,619 by Taylor discloses a method of placing the weight in the ball within a cylindrical hole with a disk-cap for inserting and removing weights. U.S. Pat. No. 4,523,757 by Swett et al., shows a bowling ball with at least six (6) weight receptacles on perpendicular axes of the ball. U.S. Pat. No. 746,576 by Rice shows finger holes designed to receive the weights on the inside thereof. U.S. Pat. No. 189,674 by Woods also shows ten-pin bowling balls with finger holes designed to receive weights. Furthermore, U.S. Pat. No. 4,320,899 by Calvino shows bowling balls with a pair of internal weights positioned at the intersection of the finger and thumb holes to counter the weight loss caused by drilling the finger holes.

Unfortunately, the problem with many of the patents in the prior art is that weights implanted to increase stability make it difficult to curve or hook the ball, which is necessary to obtain a proper hit in ten-pin bowling.

On the other hand, the instant invention not only improves stability of the ball, but improves handling characteristics to enable the ball to be hooked properly by the bowler. The instant invention uses three weights which are implanted within the core of the ball, preferably one of the weights halfway between the thumb hole and the two finger holes, and the other two at the 3 and 9 o'clock position from the first weight. The middle weight creates an end over end rolling effect of the ball, whereas the three and nine o'clock weights create leverage to pull the ball to the left or right, respectively, when it is hooked by a right- or left-handed bowler. The latter characteristic illustrates the leverage effect of this unique weight block system.

SUMMARY OF THE INVENTION

One object of the invention is to provide improved bowling ball construction to replace weight loss resulting from drilling thumb and finger holes in a bowling ball.

Another object of this invention is to provide a method of eliminating weight imbalance caused by drilling thumb and finger holes in the ball.

An even further object of this invention is to provide a new bowling ball that has improved handling characteristics to help yield higher scores.

The instant invention accomplishes the above and other objects by providing an improved bowling ball that has weights implanted in the core of the ball at special locations. In the preferred embodiment, three weights are implanted at special positions in the ball along two lines which intersect between the thumb and finger holes. One of the weights is preferrably a conically-shaped weight implanted in the core halfway between the thumb and two finger holes, while the remaining two weights are preferrably cylindrically-shaped and implanted at the 3 o'clock and 9 o'clock position relative to the first weight. Implanting the weights at these locations provides more stability and leverage to enable the ball to be hooked much better in either direction when a moment is imparted to the bowling ball by a bowler, whether the bowler be right- or left-handed.

Other objects, advantages and features of the invention will become more readily apparent from the following detailed description of the specific embodiments thereof when read in conjunction with the accompanying drawings.

BRIEF DESCRIPTION OF THE DRAWINGS

The drawings appended hereto are as follows.

DETAILED DESCRIPTION OF THE PREFERRED EMBODIMENT

Referring now in detail to the drawings, first the components of the instant bowling ball will be discussed, second the method of construction, third the materials, and finally the operation of the instant bowling ball.

Figure 1:
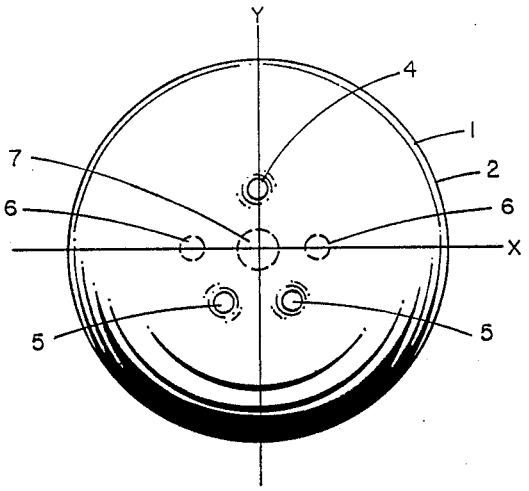
FIG. 1 is a top plan view of a bowling ball showing an x and y-axis imposed thereon.

FIG. 1 shows a standard drilled bowling ball 1 with an x and y axes superimposed thereon. A thumb hole 4 and two finger holes 5 are cut through the outer covering 2. Three weight implants are shown by dotted lines, one implant 7 between the thumb hole 4 and finger holes 5 on the intersection of the x and y axes. The other two weights 6 are shown on each side of the first weight implant 7 on the x-axis equi-distant from the y-axis passing through the thumb-hole 4.

Figure 2:
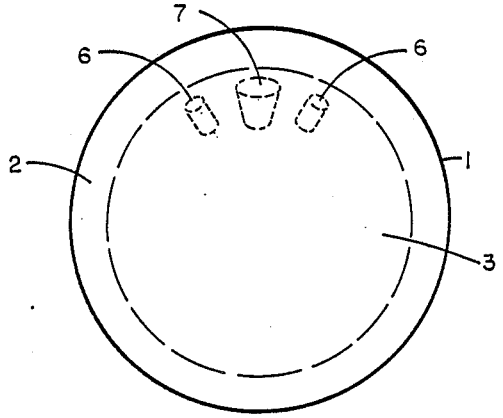
FIG. 2 is a cut-away plan view of a bowling ball of this invention.

FIG. 2 shows a side plan view of the instant bowling ball 1 with an outer covering 2 and core 3. The side weight implants 6 and a cone-shaped central weight implant 7 are also shown in the core 3 of the ball 1.

Figure 3:
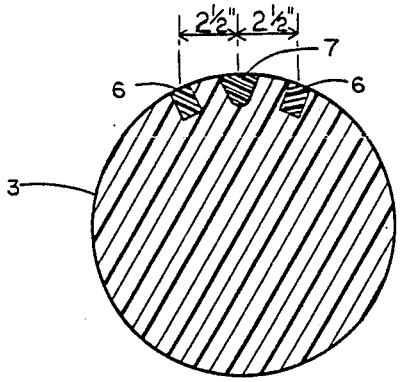
FIG. 3 is a cross-sectional side view of a core of the bowling ball with the implanted weights.

The final drawing, FIG. 3 shows the core 3 of the bowling ball 1 with side weight implants 6 and central weight implant 7 positioned therein.

The method of constructing the instant bowling ball shown in the drawings consists of taking the core 3, which is normally composed of material such as calcium carbonate (a form of baryttes) having a weight of approximately 7½ to 11 pounds and approximate size of 7½" in diameter depending, of course, on the overall weight of the ball. Next, a conical hole is drilled in the core 3 for insertion of the middle weight implant 7. The middle weight implant 7 will be made of a material such as baryttes and polyester with a weight of approximately three to eight ounces, again depending upon the weight of the ball. The middle weight implant 7 is then glued in the hole drilled for the middle weight implant 7. The two side weight implants 6 are made of the same material as the middle weight implant 7 and they vary in size normally from ¾" in diameter and ¾" in depth and in weight from ½ to ¼ ounces each. The location of the two side weight implants 6 is approximately 2½" on each side of the middle weight implant 7 at the 9 and 3 o'clock position relative to the middle weight 7. The side weight implants 6 are both inserted in cylindrical holes drilled in the ball 1.

After the three weight implants are inserted in the specified locations, a polyester cover 2 is then placed around the core 3, and the thumb hole 4 and two finger holes 5 are drilled therein.

The position of the weight implants 6 (side) and 7 (middle) not only replaces weight and eliminates imbalances caused by drilling the thumb and finger holes 4 and 7, respectively, it also gives the ball better handling characteristics. For instance, the location of the two side weight implants 6 enables the ball 1 to be more easily hooked in the desired direction, either left or right, by the bowler due to the leverage or moment resulting from the placement of the two side weight implants 6. The ability to hook the bowling ball 2 is extremely important in making a strike (i.e., knocking down all ten pins) in ten-pin bowling as a strike is best achieved by hooking the ball into the area between the head-pin (i.e., pin No. 1) and the pin next to it (i.e., either the No. 2 or No. 3 pin).

In conclusion, it should be apparent from the above description that this invention provides a bowling ball with specially designed and positioned weight implants that yields many advantages besides just alleviating weight loss and imbalance caused by drilling of the finger holes. Unlike most weighted bowling balls in the prior art in which weighted plugs make it more difficult to hook the bowling ball due to the tendency of the ball to seek a straight path, the bowling ball of the instant invention exhibits improved hooking characteristics due to the leverage effect of the side weight blocks. For instance, informal tests of the bowling ball have demonstrated that the instant invention improves significantly the scores of bowlers, even professional bowlers.

While specific embodiments of the invention have been described in detail hereinabove, it is to be understood that various modifications may be made from the specific details described hereinabove without departing from the spirit and scope of the invention as set forth in the appended claims.

Having described in detail my invention, I claim the following:

1. An improved bowling ball with a thumb hole and two finger holes comprising:

a core;

a cover surrounding and enclosing said core;

three weights spaced apart from each other within the core of the ball and disposed adjacent, between and spaced from said thumb hole and said two finger holes and having upper end surfaces terminating below said cover.

2. The bowling ball of claim 1 in which the weights are positioned within the core of the ball so that a first weight block is positioned equi-distant between the thumb hole and finger holes on a line intersecting the thumb hold and passing between the two finger holes, and the other two weights are positioned at the 9 and 3 o'clock position relative to said line intersecting the first weight block.

3. The bowling ball of claim 2 in which the other two weights are located so that the center of each of said two weights is approximately 2½" from the center of the first weight block.

4. The bowling ball of claims 2 or 3 wherein the first weight located in the middle has a conical shape.

5. The bowling ball of claims 2 or 3 wherein the other two weights are equal.

* * * * *